US005532713A

United States Patent [19]

Okada et al.

[11] Patent Number: 5,532,713

[45] Date of Patent: Jul. 2, 1996

[54] DRIVING METHOD FOR LIQUID CRYSTAL DEVICE

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 229,220

[22] Filed: Apr. 18, 1994

[30] Foreign Application Priority Data

Apr. 20, 1993 [JP] Japan ..... 5-093185

[51] Int. Cl.[6] ..... G09G 3/36

[52] U.S. Cl. ..... 345/97; 345/95; 345/210

[58] Field of Search ..... 345/97, 94, 95, 345/96, 90, 99, 100, 101, 89, 87, 208, 209, 210, 204, 58; 359/54, 55, 56, 84, 85

[56] References Cited

U.S. PATENT DOCUMENTS

| | | | |
|---|---|---|---|
| 4,367,924 | 1/1983 | Clark et al. | 350/334 |
| 4,563,059 | 1/1986 | Clark et al. | 350/330 |
| 4,639,089 | 1/1987 | Okada et al. | 350/341 |
| 4,655,561 | 4/1987 | Kanbe et al. | 350/350 S |
| 4,681,404 | 7/1987 | Okada et al. | 350/350 S |
| 4,738,515 | 4/1988 | Okada et al. | 350/350 S |
| 4,765,720 | 8/1988 | Toyono et al. | 345/97 |
| 4,778,260 | 10/1988 | Okada et al. | 350/350 S |
| 4,800,382 | 1/1989 | Okada et al. | 340/784 |
| 4,830,467 | 5/1989 | Inoue et al. | 350/333 |
| 4,836,656 | 6/1989 | Mouri et al. | 350/350 S |
| 4,844,590 | 7/1989 | Okada et al. | 350/350 S |
| 4,878,740 | 11/1989 | Inaba et al. | 350/337 |
| 4,902,107 | 2/1990 | Tsuboyama et al. | 350/350 S |
| 4,917,470 | 4/1990 | Okada et al. | 350/333 |
| 4,923,285 | 4/1990 | Ogino et al. | 350/331 T |
| 4,925,277 | 5/1990 | Inaba | 350/350 S |
| 4,930,875 | 6/1990 | Inoue et al. | 350/333 |
| 4,932,759 | 6/1990 | Toyono et al. | 350/350 S |
| 4,958,912 | 9/1990 | Inaba et al. | 350/333 |
| 4,958,915 | 9/1990 | Okada et al. | 350/345 |
| 4,973,135 | 11/1990 | Okada et al. | 350/334 |
| 5,026,144 | 6/1991 | Taniguchi et al. | 350/350 S |
| 5,034,735 | 7/1991 | Inoue et al. | 340/784 |
| 5,111,317 | 5/1992 | Coulson | 345/97 |
| 5,132,818 | 7/1992 | Mouri et al. | 359/56 |
| 5,136,282 | 8/1992 | Inaba et al. | 340/784 |
| 5,267,065 | 11/1993 | Taniguchi et al. | 359/56 |

FOREIGN PATENT DOCUMENTS

| | | |
|---|---|---|
| 0240010 | 10/1987 | European Pat. Off. . |
| 0289144 | 11/1988 | European Pat. Off. . |
| 56-107216 | 8/1981 | Japan . |
| 4218022 | 8/1992 | Japan . |

OTHER PUBLICATIONS

N. A. Clark, M. A. Handschy & S. T. Lagerwall, "Ferroelectric Liquid Crystal Electro–Optics Using the Surface Stablized Structure", Molecular Crystals and Liquid Crystals, vol. 94, 213–233, (1983).

N. A. Clark & S. T. Lagerwall, "Submicrosecond Bistable Electro–Optic Switching In Liquid Crystals", Applied Physics Letters, vol. 36, 899–901, (1980).

*Primary Examiner*—Steven Saras

*Attorney, Agent, or Firm*—Fitzpatrick, Cella, Harper & Scinto

[57] ABSTRACT

A liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines, is driven by a driving method including the steps of applying a scanning selection voltage waveform including a scanning selection signal to a scanning line within one scanning period, and applying a data signal waveform to data lines within the one scanning period. The data signal waveform is composed to include (i) a data signal period for a data signal synchronized with the scanning selection signal and providing a time-integrated voltage of zero applied to an associate pixel within the period and (ii) an AC signal period for an AC signal providing a time-integrated voltage of zero applied to the associated pixel within the AC signal period. As a result, a pixel on a selected scanning line written in an optical state, particularly a halftone state, is not affected by data signals applied for writing in pixels on a subsequently selected scanning line regardless of a relaxation time exhibited by the liquid crystal at the time of switching thereof.

5 Claims, 13 Drawing Sheets

A: CROSSTALK COMPENSATION SIGNAL
B: DC COMPENSATION SIGNAL
C: DATA SIGNAL
D: FIRST NONSELECTION SIGNAL PERIOD

V = 0

V < Vth

Vth<V<Vsat

Vsat < V

A: CROSSTALK COMPENSATION SIGNAL
B: DC COMPENSATION SIGNAL
C: DATA SIGNAL
D: FIRST NONSELECTION SIGNAL PERIOD

μsec

| | h1 | h2 | h3 | h4 | tb |
|---|---|---|---|---|---|
| 0% | -10 | +10 | -10 | +10 | 32 |
| 25% | -5 | +15 | -15 | +5 | 25 |
| 50% | +10 | -15 | +10 | -5 | 18 |
| 75% | +10 | -11 | +10 | -9 | 12 |
| 100% | +10 | -10 | +10 | -10 | 6 |

1H = 3ΔT
Ve : CLEAR VOLTAGE Vs: SCAN SIGNAL VOLTAGE
Vi : DATA SIGNAL VOLTAGE
ΔT : 1ST. WRITING PERIOD
δ : 2ND. WRITING PERIOD (ΔT/ξ)
t1,t2 : INITIAL PERIOD DETERMINED IN RELATION TO DATA SIGNAL

A : CROSSTALK COMPENSATION SIGNAL

B : DC COMPENSTATION SIGNAL

C : DATA SIGNAL

D : FIRST NONSELECTION PERIOD AFTER LINE SELECTION $ta = tb'/2$

DRIVING METHOD FOR LIQUID CRYSTAL DEVICE

FIELD OF THE INVENTION AND RELATED ART

The present invention relates to a method for driving a liquid crystal device usable in television receivers, image projectors, electronic view finders for cameras, liquid crystal light valves, planar display apparatus, etc.

A liquid crystal display device of a passive matrix drive scheme using a TN-liquid crystal has bee known as one which can be produced at a relatively low cost. However, this type of liquid crystal display device has a limitation in respect of crosstalk or contrast and cannot be considered as being suitable for a display device having high-density display lines, e.g., a liquid crystal television panel.

Clark and Lagerwall have disclosed a bistable ferroelectric liquid crystal device using a surface-stabilized ferroelectric liquid crystal in, e.g., Applied Physics Letters, Vol. 36, No. 11 (Jun. 1, 1980), p.p. 899–901; Japanese Laid-Open Patent Application (JP-A) 56-107216, U.S. Pat. Nos. 4,367,924 and 4,563,059. Such a bistable ferroelectric liquid crystal device has been realized by disposing a liquid crystal between a pair of substrates disposed with a spacing small enough to suppress the formation of a helical structure inherent to liquid crystal molecules in chiral smectic C phase (SmC*) or H phase (SmH*) of bulk state and align vertical (smectic) molecular layers each comprising a plurality of liquid crystal molecules in one direction.

Further, as a display device using such a ferroelectric liquid crystal (FLC), there is known one wherein a pair of transparent substrates respectively having thereon a transparent electrode and subjected to an aligning treatment are disposed to be opposite to each other with a cell gap of about 1–3 μm therebetween so that their transparent electrodes are disposed on the inner sides to form a blank cell, which is then filled with a ferroelectric liquid crystal, as disclosed in U.S. Pat. Nos. 4,639,089; 4,655,561; and 4,681,404.

The above-type of liquid crystal display device using a ferroelectric liquid crystal has two advantages. One is that a ferroelectric liquid crystal has a spontaneous polarization so that a coupling force between the spontaneous polarization and an external electric field can be utilized for switching. Another is that the long axis direction of a ferroelectric liquid crystal molecule corresponds to the direction of the spontaneous polarization in a one-to-one relationship so that the switching is effected by the polarity of the external electric field. More specifically, the ferroelectric liquid crystal in its chiral smectic phase show bistability, i.e., a property of assuming either one of a first and a second optically stable state depending on the polarity of an applied voltage and maintaining the resultant state in the absence of an electric field. Further, the ferroelectric liquid crystal shows a quick response to a change in applied electric field. Accordingly, the device is expected to be widely used in the field of e.g., a high-speed and memory-type display apparatus.

A ferroelectric liquid crystal generally comprises a chiral smectic liquid crystal (SmC* or SmH*), of which molecular long axes form helixes in the bulk state of the liquid crystal. If the chiral smectic liquid crystal is disposed within a cell having a small gap of about 1–3 μm as described above, the helixes of liquid crystal molecular long axes are unwound (N. A. Clark, et al., MCLC (1983), Vol. 94, p.p. 213–234).

A liquid crystal display apparatus having a display panel constituted by such a ferroelectric liquid crystal device may be driven by a multiplexing drive scheme as described in U.S. Pat. No. 4,655,561, issued to Kanbe et al to form a picture with a large capacity of pixels. The liquid crystal display apparatus may be utilized for constituting a display panel suitable for, e.g., a word processor, a personal computer, a micro-printer, and a television set.

A ferroelectric liquid crystal has been principally used in a binary (bright-dark) display device in which two stable states of the liquid crystal are used as a light-transmitting state and a light-interrupting state but can be used to effect a multi-value display, i.e., a halftone display. In a halftone display method, the areal ratio between bistable states (light transmitting state and light-interrupting state) within a pixel is controlled to realize an intermediate light-transmitting state. The gradational display method of this type (hereinafter referred to as an "areal modulation" method) will now be described in detail.

FIG. 1 is a graph schematically representing a relationship between a transmitted light quantity I through a ferroelectric liquid crystal cell and a switching pulse voltage V. More specifically, FIG. 1A shows plots of transmitted light quantities I given by a pixel versus voltages V when the pixel initially placed in a complete light-interrupting (dark) state is supplied with single pulses of various voltages V and one polarity as shown in FIG. 1B. When a pulse voltage V is below threshold Vth (V<Vth), the transmitted light quantity does not change and the pixel state is as shown in FIG. 2B which is not different from the state shown in FIG. 2A before the application of the pulse voltage. If the pulse voltage V exceeds the threshold Vth (Vth<V<Vsat), a portion of the pixel is switched to the other stable state, thus being transitioned to a pixel state as shown in FIG. 2C showing an intermediate transmitted light quantity as a whole. If the pulse voltage V is further increased to exceed a saturation value Vsat (Vsat<V), the entire pixel is switched to a light-transmitting state as shown in FIG. 2D so that the transmitted light quantity reaches a constant value (i.e., is saturated). That is, according to the areal modulation method, the pulse voltage V applied to a pixel is controlled within a range of Vth<V<Vsat to display a halftone corresponding to the pulse voltage.

However, actually, the voltage (V)–transmitted light quantity (I) relationship shown in FIG. 1 depends on the cell thickness and temperature. Accordingly, if a display panel is accompanied with an unintended cell thickness distribution or a temperature distribution, the display panel can display different gradation levels in response to a pulse voltage having a constant voltage.

FIG. 3 is a graph for illustrating the above phenomenon which is a graph showing a relationship between pulse voltage (V) and transmitted light quantity (I) similar to that shown in FIG. 1 but showing two curves including a curve H representing a relationship at a high temperature and a curve L at a low temperature. In a display panel having a large display size, it is rather common that the panel is accompanied with a temperature distribution. In such a case, however, even if a certain halftone level is intended to be displayed by application of a certain drive voltage Vap, the resultant halftone levels can be fluctuated within the range of $I_1$ to $I_2$ as shown in FIG. 3 within the same panel, thus failing to provide a uniform gradational display state.

In order to solve the above-mentioned problem, our research and development group has already proposed a drive method (hereinafter referred to as the "four pulse method") in JP-A 4-218022. In the four pulse method, as illustrated in FIGS. 4 and 5, all pixels having mutually different thresholds on a common scanning line in a panel are supplied with plural pulses (corresponding to pulses (A)–(D) in FIG. 4) to show consequently identical transmitted quantities as shown at FIG. 4(D). In FIG. 5, $T_1$, $T_2$ and $T_3$ denote selection periods set in synchronism with the pulses (B), (C) and (D), respectively. Further, $Q_0$, $Q_0'$, $Q_1$, $Q_2$ and $Q_3$ in FIG. 4 represent gradation levels of a pixel, inclusive of $Q_0$ representing black (0%) and $Q_0'$ representing white (100%). Each pixel in FIG. 4 is provided with a threshold distribution within the pixel increasing from the leftside toward the right side as represented by a cell thickness increase.

However, in the case where a pixel is provided with regions having different thresholds and is used to effect a halftone display depending on the size of an inverted area, the halftone display state can be disturbed by a subsequent nonselection signal in some cases.

More specifically, with reference to FIG. 5, a display state of a pixel on a scanning line S1 determined by application of a writing pulse (B) in synchronism with a data signal $I_1$ in phase $T_1$ can be disturbed by a data signal I, in a subsequent nonselection period $T_1'$ in some cases.

SUMMARY OF THE INVENTION

An object of the present invention is to provide a driving method for a liquid crystal device having solved the above-mentioned problems and capable of effecting a halftone display at a good reproducibility.

According to the present invention, there is provided a driving method for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines; said driving method comprising:

applying a scanning selection voltage waveform including a scanning selection signal to a scanning line within one scanning period, and applying a data signal waveform to data lines within the one scanning period;

said data signal waveform being composed to include (i) a data signal period for a data signal synchronized with the scanning selection signal and providing a time-integrated voltage of zero applied to an associate pixel within the period and (ii) an AC signal period for an AC signal providing a time-integrated voltage of zero applied to the associated pixel within the AC signal period.

According to another aspect of the present invention, there is provided a driving method for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines; said driving method comprising:

applying a scanning selection signal to a selected scanning line to write in pixels on the selected scanning line, applying a voltage level not depending on image data to the pixels on the selected scanning line for a prescribed period, and then applying a scanning selection signal to a subsequently selected scanning line to write in pixels on the scanning line.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 6A:
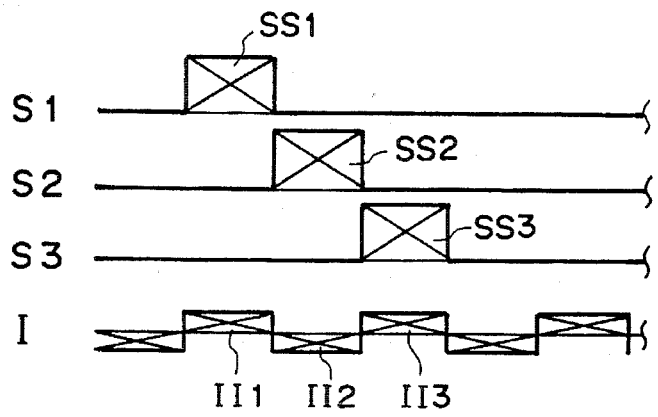
FIGS. 6A and 6B are time charts for illustrating a driving method for a liquid crystal device according to the invention.
Figure 6B:
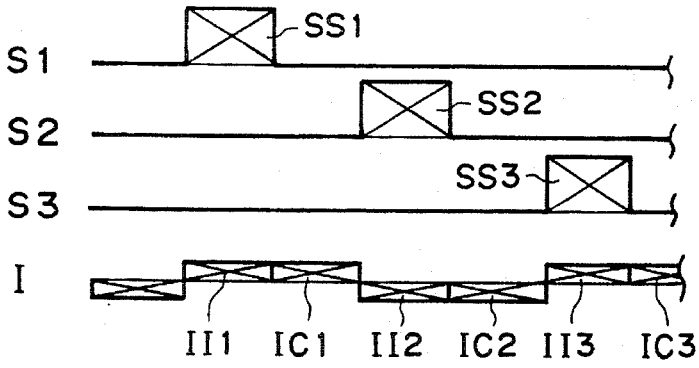

FIGS. 6A and 6B are simplified time charts for illustrating time relationship among drive signals involved in a conventional method and an embodiment of the invention, respectively. Actual forms of drive signals involved in each period denoted by ▭ will be described hereinafter.

Referring to FIGS. 6A and 6B, S1, S2 and S3 denote three adjacent scanning lines, and I denotes a certain data line.

Signal periods SS1, SS2 and SS3 denote selection periods for the scanning lines S1, S2 and S3, respectively. II1, II2 and II3 denote data signal periods for pixels at intersections of the data line I and the scanning lines S1, S2 and S3, respectively, and signals determining the display states of the pixels when selected are applied during these periods.

IC1, IC2 and IC3 denote crosstalk-prevention periods adopted in the present invention for applying signals for preventing crosstalk signals, the details of which will be described hereinafter. During the periods IC1–IC3, no selection signals are applied to the scanning lines S1–S3. For example, in the period IC1, no selection signal is applied to the scanning line S2 so that the pixel S2-I does not change its display state even if the data line I is supplied with a crosstalk-prevention signal.

According to the present invention, in the crosstalk-prevention period, an AC signal is applied to an associated data line. The AC signal is designed to have a positive and a negative pulse with respect to a certain reference potential (generally taken as equal to the potential level of a non-selected scanning line) so that its time-integrated voltage with respect to the reference potential becomes zero.

The present invention will be described in more detail.

For example, in the case of line-sequential scanning writing on a matrix-type liquid crystal device, a first scanning line S1 is selected to write halftone states in pixels on the scanning line S1, and then a second scanning line S2 is selected to write in pixels on the scanning line S2. In the latter writing on the scanning line S2, the scanning line S1 is retained at the reference potential but the data lines for the pixels on the scanning line S1 also receive data signals for writing in the pixels on the scanning line S2. Accordingly, the pixels on the scanning line S1 immediately after writing therein receive data signal waveforms for the subsequent scanning line S2.

In the switching (inversion) from a state 1 to another state 2 of a ferroelectric liquid crystal under application of a switching pulse (electric field), the ferroelectric liquid crystal causes a transitional phenomenon such that, even if the switching of the molecular orientation to the state 2 is not completed during the application of the switching pulse, the molecular orientation is gradually changed even after the termination of the switching pulse (pulse-down) to complete the switching to the state 2.

More specifically, in case where one of cross-nicol polarizer axes were aligned with the optical axis of a state 1 of a ferroelectric liquid crystal to assume an extinction state and then a switching pulse was applied to the ferroelectric liquid crystal so as to cause a switching to a state 2, while the optical response thereof was detected as a conversion current through a photoelectron multiplier, it was observed that the switching from the state 1 to the state 2 could be sufficiently caused finally if the optical transmittance change of about 60% (of that given by the complete switching from the state 1 to the state 2) was caused during the application of the switching pulse (voltage application).

Such a ferroelectric liquid crystal in an orientation state showing only a transmittance of 60% at the time of termination of the switching pulse gradually assumes an alignment state showing a transmittance of 100% within a relaxation time of about 200–500 μsec after the pulse termination.

The inversion stage of a ferroelectric liquid crystal always includes such a relaxation time up to the completion of the inversion except for the case of a low-voltage application (on the order of 1–3 volts) where the enlargement of a domain wall, i.e., the enlargement of an inverted region, is controlling.

It has been observed that such an orientation state within the relaxation time, having not yet reached a stable state, is very susceptible of disturbance by an external field.

The following are experimental procedure and results showing the above-mentioned phenomena.

Figure 7:
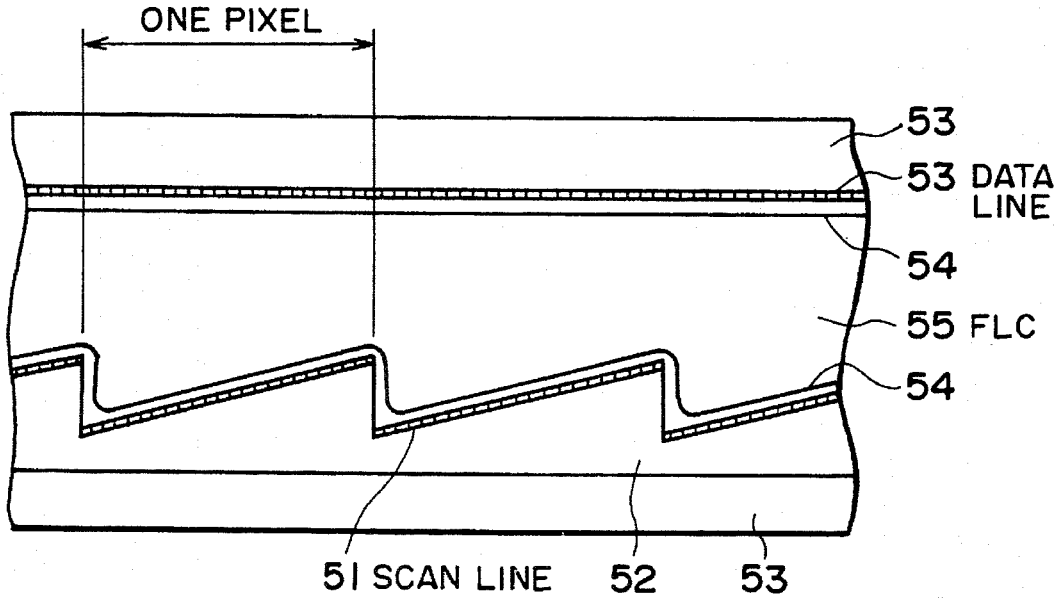
FIG. 7 is a schematic sectional view of a liquid crystal cell applicable to the invention.

A liquid crystal cell having a sectional structure as shown in FIG. 7 was prepared. The lower glass substrate 53 was provided with a saw-teeth shape cross section by transferring an original pattern formed on a mold onto a UV-curable resin layer applied thereon to form a cured acrylic resin layer 52.

The thus-formed UV-cured uneven resin layer 52 was then provided with stripe electrodes 51 of ITO film by sputtering and then coated with an about 300 Å-thick alignment film (formed with "LQ-1802", available from Hitachi Kasei K. K.).

The opposite glass substrate 53 was provided with stripe electrodes 51 of ITO film on a flat inner surface and coated with an identical alignment film.

Both substrates (more accurately, the alignment films thereon) were rubbed respectively in one direction and superposed with each other so that their rubbing directions were roughly parallel but the rubbing direction of the lower substrate formed a clockwise angle of about 6 degrees with respect to the rubbing direction of the upper substrate. The cell thickness (spacing) was controlled to be from about 1.0 μm as the smallest thickness to about 1.4 μm as the largest thickness. Further, the lower stripe electrodes 51 were formed along the ridge or ripple (extending in the thickness direction of the drawing) so as to provide one pixel width having one saw tooth span. Thus, rectangular pixels each having a size of 300 μm×200 μm were formed.

Then, the cell was filled with a chiral smectic liquid crystal A showing the following phase transition series and properties.

TABLE 1

(liquid crystal A)

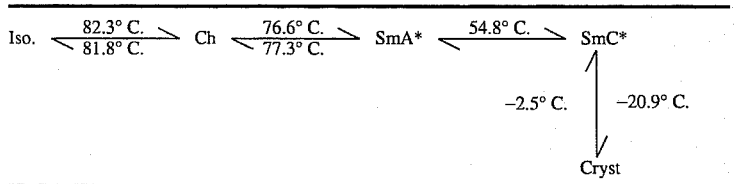

Ps = −5.8 nC/cm$^2$ (30° C.)
Tilt angle = 14.3 deg. (30° C.)
$\Delta\epsilon \doteqdot -0$ (30° C.)

Figure 8A:
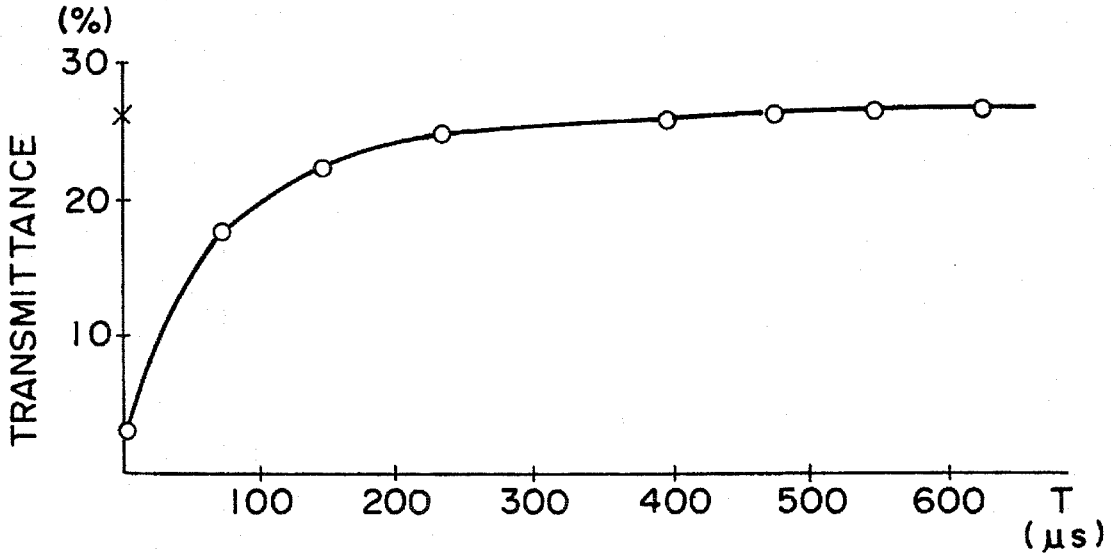
FIG. 8A is a graph showing a change in written halftone level (transmittance) depending on the relaxation time, and FIG. 8B illustrate writing signals.
Figure 8B:
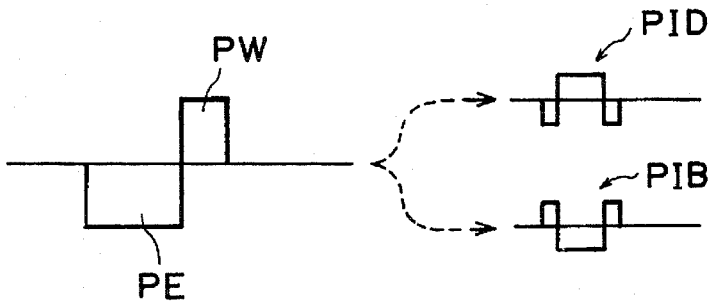

After writing a halftone in the sample cell by applying a writing signal having a duration of 40 μsec and comprising a clear pulse PE and a writing pulse PW, as shown in FIG. 8B, the pair of electrodes sandwiching the liquid crystal layer were both lowered to a ground potential (as a reference potential) so that no electric field was applied to the liquid crystal layer for a variable time T (μsec), and then the cell was supplied with a bipolar pulse signal PID having a duration of totally 80 μsec which was equal to twice the pulse width (40 μsec) of the writing pulse PW and including a preceding pulse of a polarity opposite to that of the writing pulse PW and a peak height which was 5/12 of that (12 volts) of the writing pulse PW. FIG. 8A is a graph showing a variation of the written halftone level obtained by changing the above-mentioned time T.

As shown in FIG. 8B, when T=∞, the written level (transmittance) was 27%, while the written level was changed to 3% when T=0. Further, the written level was about 20% for T=100 μsec, 24% for T=200 μsec, and 25% for T=300 μsec.

FIG. 8 shows that the disturbance of the intermediate display state (crosstalk) caused by application of subsequent voltage pulses after the writing is decreased exponentially with the increase of the standing time T.

On the other hand, application of a bipolar pulse signal PIB, as shown in FIG. 8B, having a preceding pulse of a polarity identical to that of the writing pulse PW causes an increase in transmittance of the resultant halftone display. For example, the resultant transmittance was about 47% for T=0 in the above-mentioned case.

Accordingly, in case of a conventional device, it has been difficult to effect a stable halftone display, because (1) the switching of a ferroelectric liquid crystal involves a relaxation time having a characteristic as described above and (2) in the case of a matrix drive, a pixel immediately after writing is supplied with data signals (non-selection signals) for pixels on subsequently selected scanning lines.

In the present invention, the crosstalk caused by the presence of the relaxation time is obviated in a manner as described hereinbelow with reference to two embodiments.

(1) After application of a writing pulse, a crosstalk prevention period is provided wherein a subsequent scanning line is not selected immediately, and after lapse of the relaxation time, a pixel (i.e., a liquid crystal layer) is supplied with a specific voltage waveform.

(2) A data signal is composed to include (i) a period of a signal carrying image data in synchronism with a scanning signal and providing a time-integrated voltage of zero applied to the liquid crystal layer and (ii) another period (crosstalk-prevention period) of an AC signal providing a time-integrated voltage of zero applied to the liquid crystal layer.

As a result, the liquid crystal layer after the writing is subjected to application of an AC signal providing a time-integrated voltage of zero for a period of at least the relaxation time (300 μsec) as shown in FIG. 8A to keep the crosstalk quantity (transmittance change due to crosstalk) at constant, thereby stabilizing the halftone display.

More specifically, in case of a matrix drive as in an embodiment described below, a spacing between scanning selection periods is taken for a period of one horizontal scanning (1H) in the case of line-sequential scanning.

Further, the data signal synchronized with the spacing is composed as an AC (alternating) signal providing a time-integrated value of zero.

Figure 9:
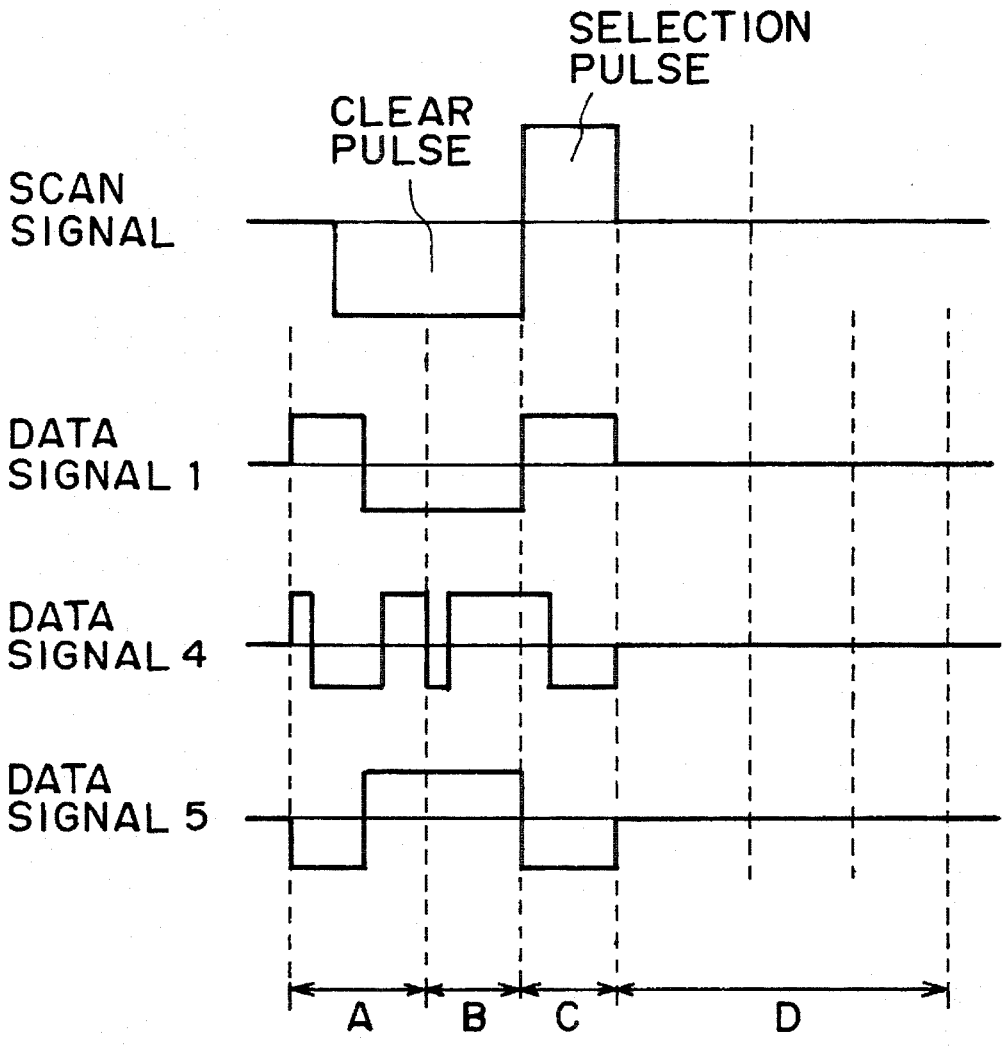
FIG. 9 is a time-serial waveform diagram showing a set of drive signals used in the invention.

FIG. 9 shows a scanning signal waveform and data signal waveforms for halftone display. The data signal waveforms are varied depending on halftone levels to be displayed. The scanning signals (i.e., a voltage waveform applied to a scanning line) includes a clear pulse for resetting the display states of all the pixels on a selected scanning line and a selection pulse for writing halftones in the pixels depending on the corresponding halftone data signals.

The selection pulse has a width C in which data signals also have image data. A period B is placed next to the period C so as to cancel or compensate for the DC component involved in the period C. The periods B and C are essential for writing a halftone and are inclusively referred to as a data signal period.

However, in case where the data signals are composed by a succession of the data signal periods by applying, immediately after the application of the selection pulse, a clear pulse and a selection pulse for pixels on a subsequent scanning line, the crosstalk inevitably occurs, so that a good halftone display cannot be accomplished. For this reason, a period A (crosstalk-prevention period) is placed before the data signal period. By changing the waveform in the period A depending on the waveform within the data signal period, the crosstalk can be obviated.

A pulse applied to a pixel through a data line in a period D (period after application of the writing pulse) is more liable to cause crosstalk if it is applied in an earlier instant, as far as it is within the relaxation time (that is, a larger crosstalk is caused as T approaches 0 in FIG. 8A). Accordingly, in case where a data signal for a pixel on a subsequent scanning line is applied in a period D (FIG. 9) immediately after the writing, the voltage waveform of the data signal greatly affects the direction of the crosstalk (whether it increases or decreases the transmittance) and the quantity thereof (transmittance change due to the crosstalk).

Figure 10A:
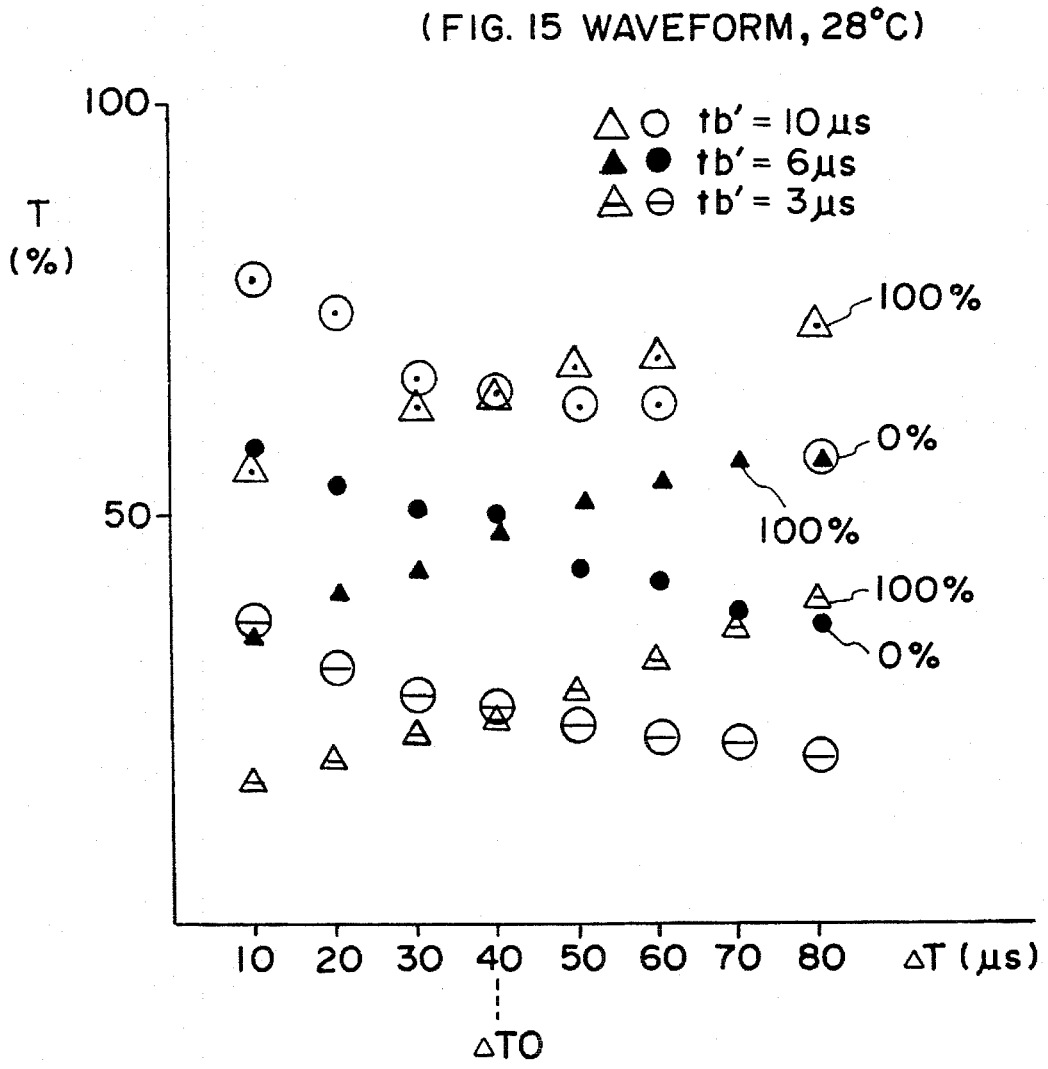
FIG. 10A is a graph showing a relationship between the transmittance and the relaxation time and FIG. 10B show data signal waveforms used therefor.
Figure 10B:
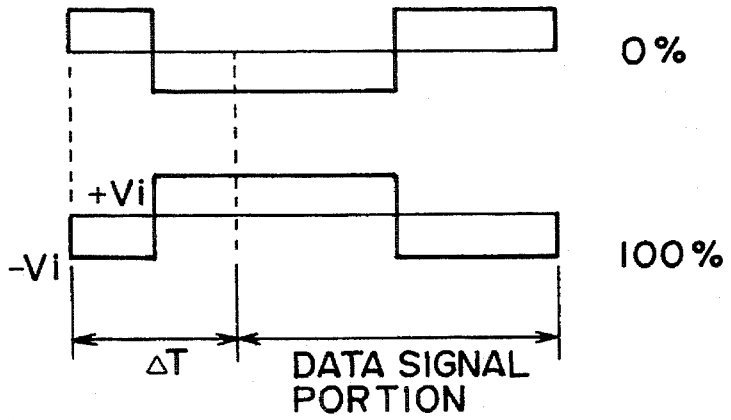

Referring to FIG. 9, Data signal 1 is a data signal for providing a transmittance of 0%, and Data signal 5 is a data signal for providing a transmittance of 100%. If Data signal 1 is considered in case where no period A is involved, a negative polarity pulse is applied in the period "B" and a positive polarity pulse is applied in the period "C" for identical periods. In such a case (assuming that a negative data pulse is used for switching to a bright state), a crosstalk occurs in a direction (hereinafter referred to as a "positive direction") of increasing the resultant transmittance. In case of Data signal 5, a positive pulse is applied in the period B and a negative pulse is applied in the period C for identical periods. In this case, if no period A is present, a crosstalk occurs in a direction (referred to as a "negative direction") of decreasing the resultant transmittance. The difference in optical transmittance amounts to 20% or larger between the case where Data signal 1 (0%) is applied immediately after writing and the case where Data signal 5 (100%) is applied immediately after writing, as shown in FIG. 10.

If a case where a period A is placed before the periods B and C, a pulse applied earlier in the period A within the relaxation time has a larger influence, so that the influence of Data signal 1, for example, in the periods B and C (i.e., for causing crosstalk in the positive direction) can be canceled by appropriately organizing pulses in the period A.

For Data signal 1 having negative and positive pulses in the periods B and C, respectively, it is appropriate to dispose a bipolar signal in the period A so as to include a positive preceding pulse having a pulse width which is a half of the period A.

For Data signal 5 having reverse polarity pulses in the periods B and C, it is appropriate to include bipolar pulses having also reverse polarities in the period A, respectively compared with Data signal 1.

Data signal portions ("B"+"C") of the signals for 0% and 100% correspond to cases that the data signals cause maximum crosstalks. Accordingly, if the crosstalks caused by the data signals for 0% and 100% are corrected or canceled by disposing reverse-phase bipolar pulses in the period A, it is also possible to cancel the crosstalk caused by any halftone signal between 0–100% by adjusting the voltage waveform in the period A.

The length ΔT of the period A was changed so as to obtain an appropriate value $\Delta T_0$ by which these crosstalks by both data signals for 0% and 100% based on the set of signals shown in FIG. 9 (identical to FIG. 15 in which parameters tb' are defined) under the conditions that the scanning signal voltage levels of ±14 volts and the data signal voltage levels of ±4 volts at 28° C. The results are summarized in FIG. 10A. The period "A" for canceling the crosstalks caused by the data signals for 0% and 100% can exceed $\Delta T_0$ but should be $\Delta T_0$ at the minimum.

FIG. 10 shows that ΔT=40 μsec (=$\Delta T_0$) provided an identical transmittance even if either one of the data signals for 0% and 100% followed. That is, the crosstalk could be eliminated.

In this way, a display disorder due to the crosstalk can be alleviated by composing a data signal so as to include an AC signal-application period ("A") for crosstalk prevention in addition to a data signal application period ("B"+"C").

The above description is based on a case where the crosstalk-preventing bipolar signals have a constant voltage peak height and are phase-modulated, but it is also possible to constitute the crosstalk-preventing bipolar signals by voltage modulation instead of or in addition to the phase modulation.

The period "A" need not be placed immediately before the period "B" or immediately after the period "C", but a period of a reference potential level can be placed before and/or after the period "A". In view of the efficiency of pulses within the relaxation time, it is desirable to place the period "A" prior to and continuous to the period "B", thereby shortening the one scanning time (1H).

The above-mentioned method of crosstalk removal may be applicable to drive of ferroelectric liquid crystals in general.

In the above embodiments, a halftone display is realized by providing a cell thickness gradient in a pixel, but the present invention can be applicable to other device structures for halftone display, such as one wherein at least one of opposite electrodes is provided with microscopic unevennesses formed regularly or at random; one wherein at least one of opposite electrodes is provided with stripe unevennesses formed at a regular pitch (of e.g., 0.5 μm); or one wherein a halftone display is provided by a factor other than a cell thickness distribution (e.g., a periodical distortion of smectic layers).

[First Embodiment]

In a specific example of this embodiment, the above-mentioned cell structure and liquid crystal material were used.

Figures 11A, 11B:
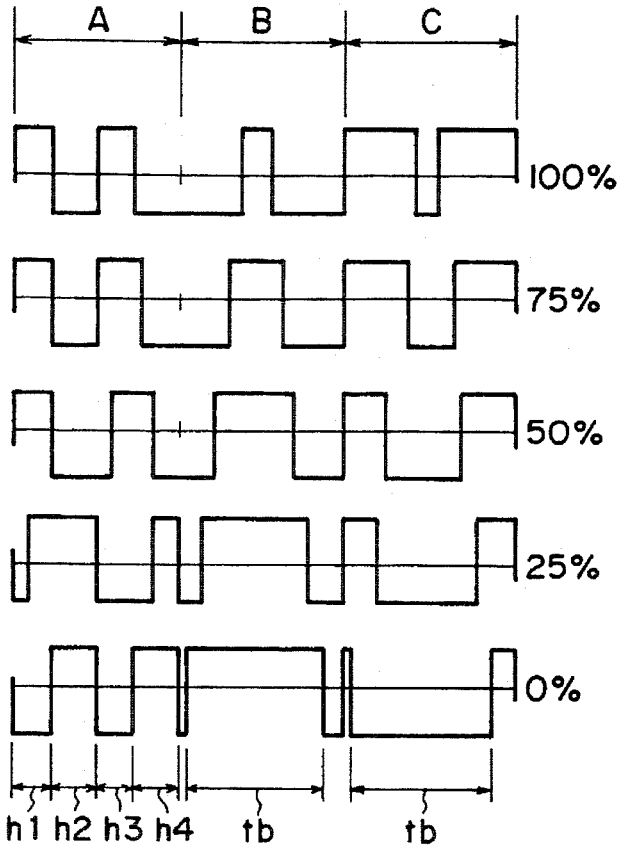
FIG. 11A illustrates a set of data signals used in a first embodiment of the invention.
FIG. 11B is a table showing the sign and pulse widths of unit pulses.
Figure 12:
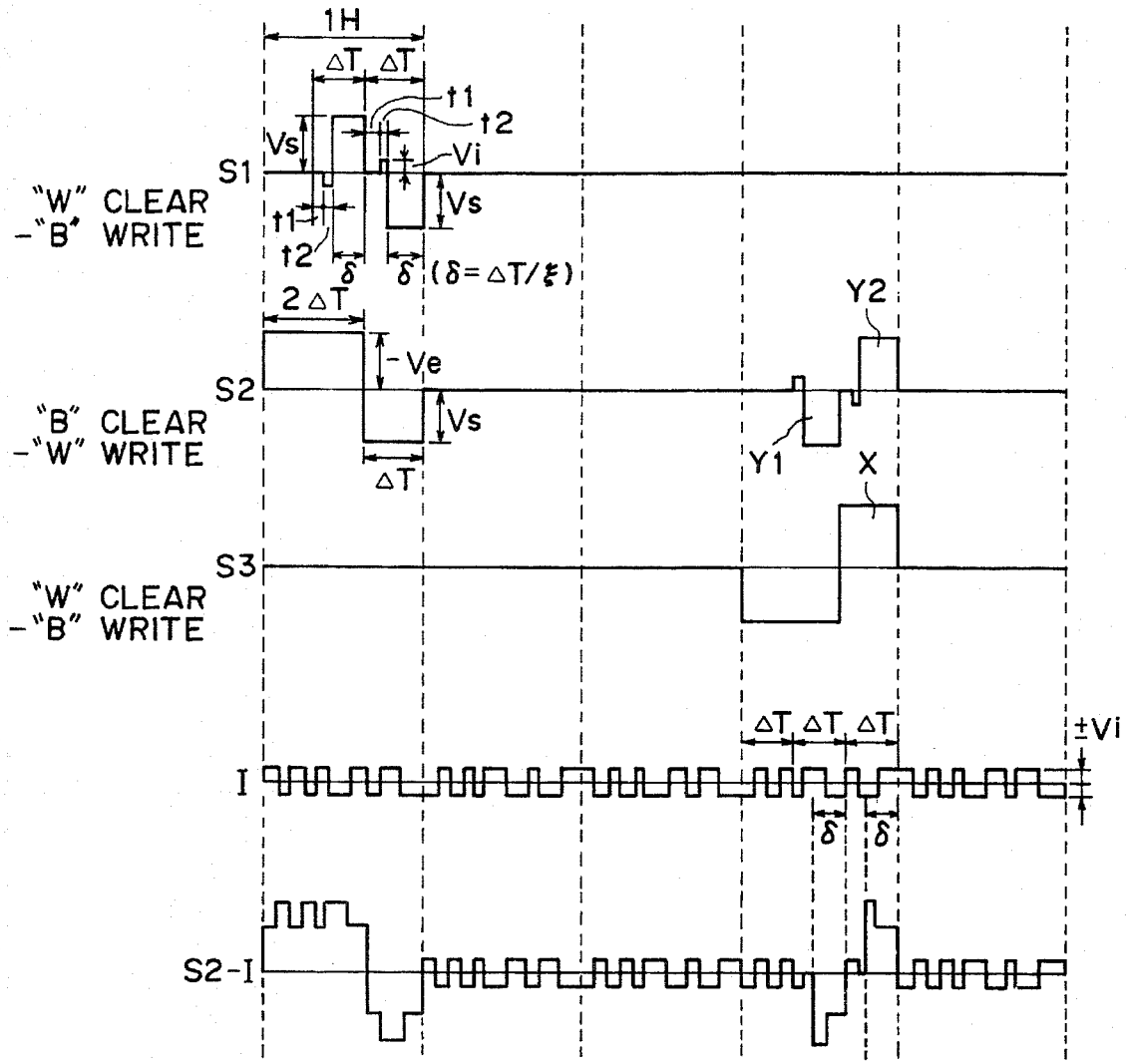
FIG. 12 is a time serial waveform diagram showing a set of drive signals used in a first embodiment of the invention.

FIGS. 11A and 11B show some typical data signals and FIG. 12 is a time-serial waveform diagram including a set of drive signals involved in the example.

Figure 13:
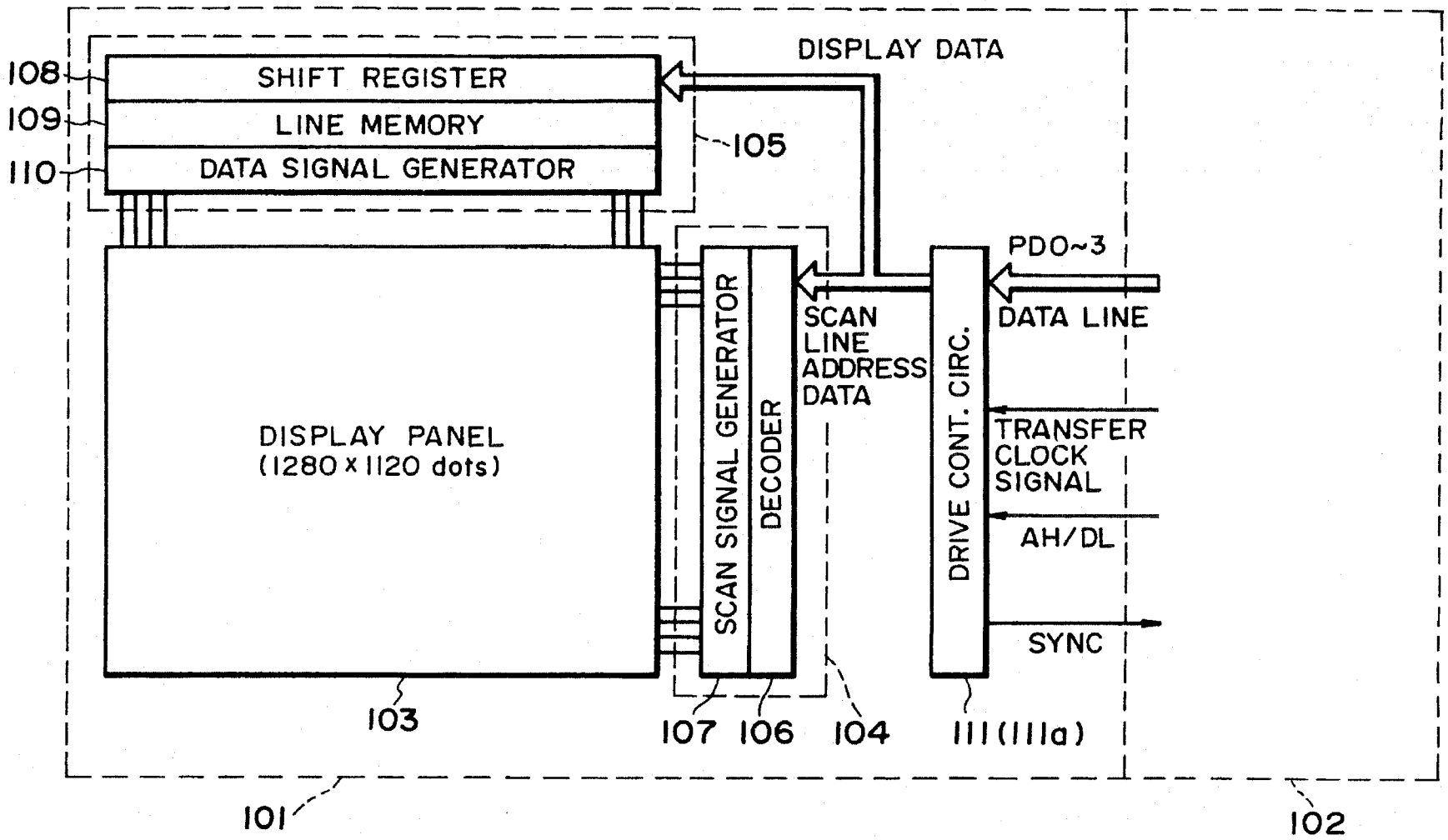
FIG. 13 is a block diagram of a drive circuit applicable to the invention.
Figure 14:
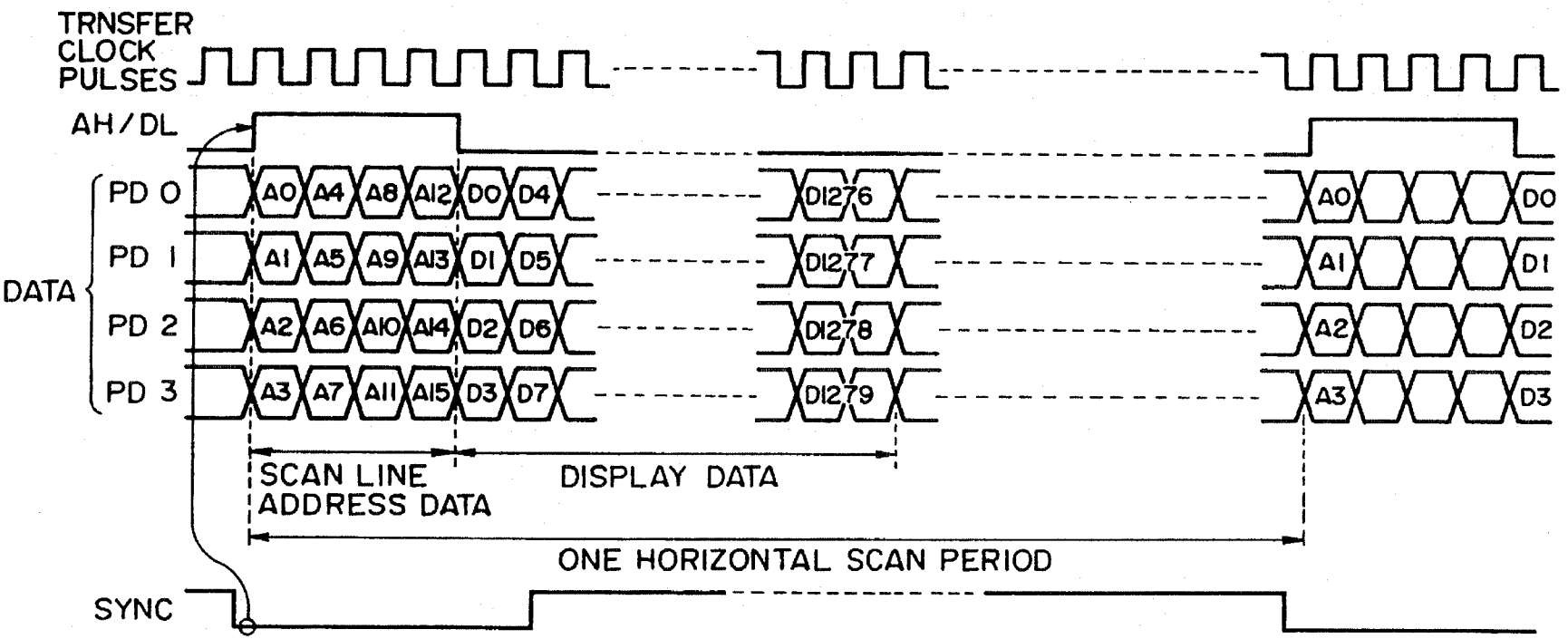
FIG. 14 is a time chart for the driving circuit shown in FIG. 13.

FIG. 13 is a block diagram of a display apparatus including the above-mentioned liquid crystal cell (panel) to be driven according to this embodiment the present invention, and FIG. 14 is a time chart for communication of image data therefor. Hereinbelow, the operation of the apparatus will be described with reference to these figures.

A graphic controller 102 supplies scanning line address data for designating a scanning electrode and image data PD0–PD3 for pixels on the scanning line designated by the address data to a display drive circuit constituted by a scanning line drive circuit 104 and a data line drive circuit 105 of a liquid crystal display apparatus 101. In this embodiment, scanning line address data (A0–A15) and display data (D0–D1279) must be differentiated. A signal AH/DL is used for the differentiation. The AH/DL signal at a high (Hi) level represents scanning line address data, and the AH/DL signal at a low (Lo) level represents display data.

The scanning line address data is extracted from the image data PD0–PD3 in a drive control circuit 111 in the liquid crystal display apparatus 101 outputted to the scanning line drive circuit 104 in synchronism with the timing of driving a designated scanning line. The scanning line address data is inputted to a decoder 106 within the scanning line drive circuit 104, and a designated scanning electrode within a display panel 103 is driven by a scanning signal generation circuit 107 via the decoder 106. On the other hand, display data is introduced to a shift register 108 within the data line drive circuit 105 and shifted by four pixels as a unit based on a transfer clock pulse. When the shifting for 1280 pixels on a horizontal one scanning line is completed by the shift register 108, display data for the 1280 pixels are transferred to a line memory 109 disposed in parallel, memorized therein for a period of one horizontal scanning period and outputted to the respective data electrodes from a data signal generation circuit 110.

Further, in this embodiment, the drive of the display panel 103 in the liquid crystal display apparatus 101 and the generation of the scanning line address data and display data in the graphic controller 102 are performed in a non-synchronous manner, so that it is necessary to synchronize the graphic controller 102 and the display apparatus 101 at the time of image data transfer. The synchronization is performed by a signal SYNC which is generated for each one horizontal scanning period by the drive control circuit 111 within the liquid crystal display apparatus 101. The graphic controller 102 always watches the SYNC signal, so that image data is transferred when the SYNC signal is at a low level and image data transfer is not performed after transfer of image data for one scanning line at a high level. More specifically, referring to FIG. 13, when a low level of the SYNC signal is detected by the graphic controller 102, the AH/DL signal is immediately turned to a high level to start the transfer of image data for one horizontal scanning line. Then, the SYNC signal is turned to a high level by the drive control circuit 111 in the liquid crystal display apparatus 101. After completion of writing in the display panel 103 with lapse of one horizontal scanning period, the drive control circuit 111 again returns the SYNC signal to a low level so as to receive image data for a subsequent scanning line. The drive control circuit 111 includes a circuit 111*a* for setting a crosstalk-prevention period and for modulating the crosstalk prevention signals depending on data signal waveforms.

Referring again to FIGS. 11A and 11B, the data signals include periods A, B and C each set to ΔT =40 μsec, and all the data signals have amplitudes of ±4.0 volts. The pulses in the periods B and C of the data signals are set to have a pulse width tb which is varied within a modulation range of 6 μsec to 32 μsec. At tb=6 μsec, a data of 100% is displayed, and tb=32 μsec is set for 0%. The variable range of tb is set to be smaller than ΔT (=40 μsec).

The period "C" is for a data signal portion which is applied with a portion X of a scanning signal shown at S1–S3 in FIG. 12, and the period "B" is for a data signal portion for canceling the DC component of the data signal portion C and is applied in synchronism with a portion $Y_1$ of the scanning signal. The data signal is most characterized by the portion A (shown in FIG. 11A) for crosstalk-prevention.

In this embodiment, the data signal portion "A" included four alternating polarity pulses having widths h1–h4 (μsec) and, by controlling the polarities and the widths of these pulses, the crosstalk due to subsequent data signal portions "B" and "C" could be obviated.

The widths h1–h4 and tb for constituting typical data signals are summarized in a table of FIG. 11B wherein the signs and numbers represent the polarities and widths, respectively, of pulses concerned.

Other parameters characterizing the drive signals included in the waveforms are as follows:

|Vs|=14.0 volts (Vs: scanning signal voltage)

|Ve|=14.0 volts (Ve: clearing voltage)

|Vi|=4.0 volts (Vi: data signal voltage)

t1=ΔT (1-1/ξ) (ΔT: first writing period)

t2=0.0 μsec (t1, t2: initial periods in relation with data signals)

ξ=1.9

δ=ΔT/ξ (δ: second writing period)

1H=3ΔT

In the specific example, by using the above-described driving method, a good halftone display could be realized while obviating the crosstalk of pixels after writing on a selected scanning line due to non-selection signals (data signals for pixels on a subsequently selected scanning line).

[Second Embodiment]

Figure 15:
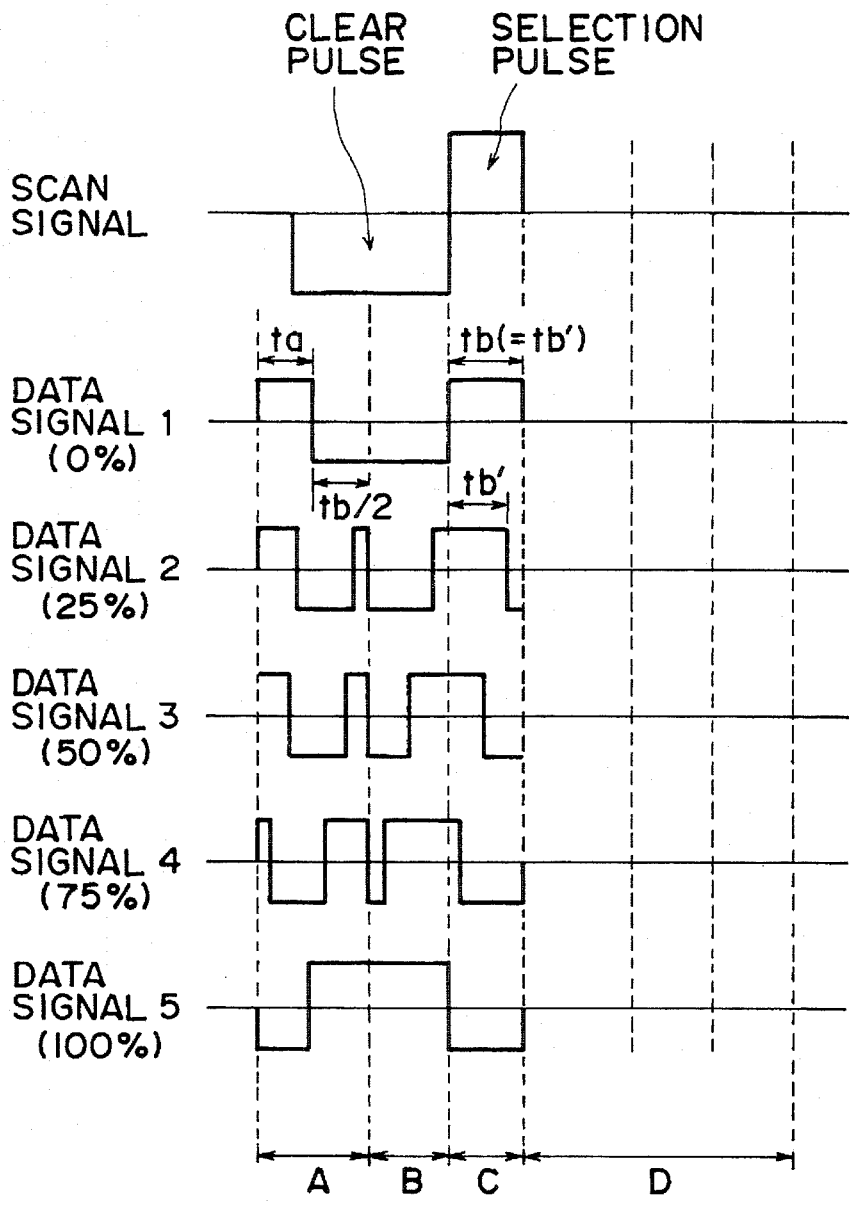
FIGS. 15, 16A and 16B illustrate sets of drive signals used in second and third embodiments, respectively, of the present invention.

In this embodiment, a set of drive signals shown in FIG. 15 are used.

The liquid crystal cell, liquid crystal material, drive circuit and system arrangement may be similar to those used in the first embodiment.

Referring to FIG. 15, each data signal includes portions corresponding to periods "A", "B" and "C". A data signal portion C includes image data synchronized with a scanning selection pulse. A data signal portion B is for canceling (compensating for) the DC component of the data signal portion C. A period A is provided for compensating for the effects of the data signal portions B and C to prevent the crosstalk. The data signal portion C has a positive pulse width tb' which is modulated in the range of 0 μsec (for providing a transmittance of 100%) to 40 μsec (for providing a transmittance of 0%).

The data signal portion B has a waveform obtained by inverting the pulse polarities of the data signal portion C. The data signal portion A basically includes three pulses including a second pulse which has a fixed pulse width of tb/2=20 μsec and a peak height −Vi=−4.0 volts.

The first pulse in the data signal portion A has a width ta=tb/2=20 μsec for a data signal for 0%, a width of 0 μsec for a data signal for 100% and has a width expressed as ta=tb'/2 which is modulated corresponding to the positive pulse width tb' in the data signal portion C. The first pulse generally has a peak height of +Vi=4.0 volts except for one corresponding to a data signal for 100%.

The third pulse in the data signal portion A has a pulse width obtained by subtracting the widths of the first and second pulses from 40 μsec. The pulse width can vary from 0 μsec (for 0%) to 20 μsec (for 100%).

The scanning signal comprises a clearing pulse of −14 volts and 80 μsec, and a selection pulse of +14 volts and 40 μsec.

[Third Embodiment]

This embodiment is directed to an improvement wherein drive signals including a crosstalk-prevention period ("A" in FIG. 15) according to the present invention are applied to a liquid crystal for a white-and-black binary display having no threshold distribution in each pixel.

Figure 16A:
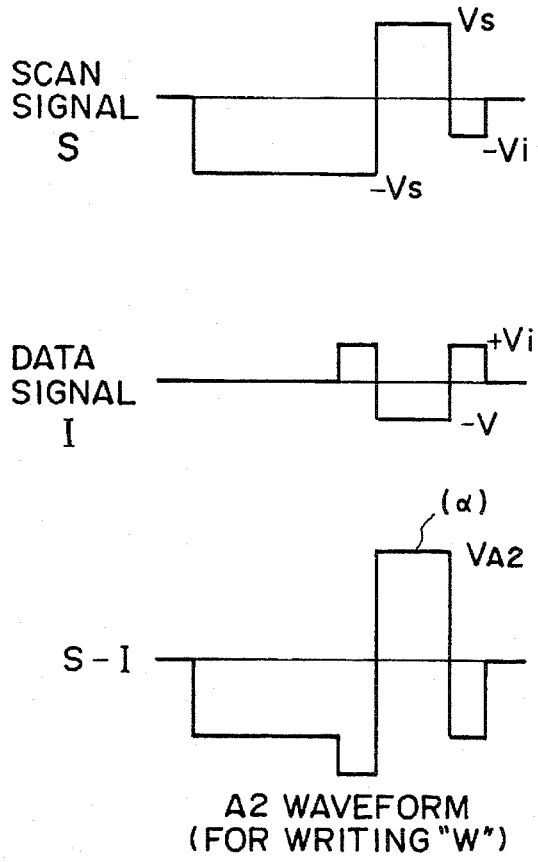
Figure 16B:
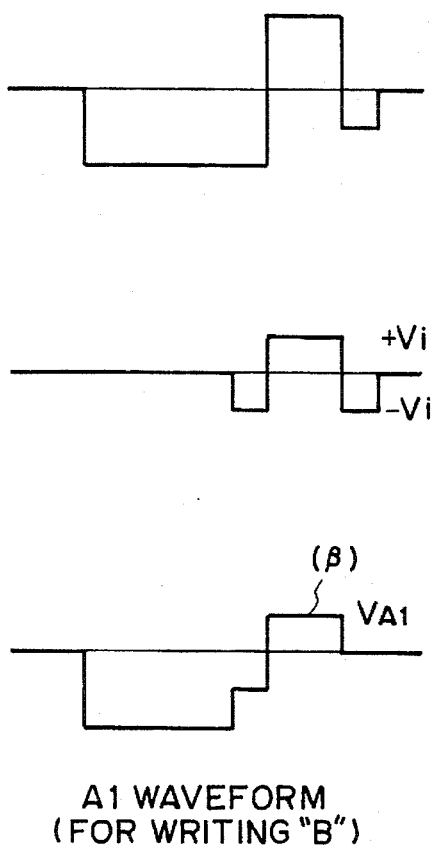

In the case of a binary display using binary waveforms, a waveform A1 for writing "black" ("B") and a waveform A2 for writing "white" ("W") as shown in FIGS. 16A and 16B may be produced by selection of data signals in some cases. In such a case, a temperature region wherein switching to "white" is not accomplished by application of the waveform A1 but accomplished by application of the waveform A2 is assumed to correspond to a temperature region wherein the switching threshold of the liquid crystal amounts to γ times due to the temperature change, if γ is defined by $\gamma=V_{A1}/V_{A2}$, wherein $V_{A1}$ denotes a writing voltage in the waveform A1 and $V_{A2}$ denotes a writing voltage in the waveform A2.

However, the actual threshold change rate γ is smaller than the theoretical value of $V_{A1}/V_{A2}$ when a ratio $V_{A2}$/Vi (data signal voltage) is increased (FIG. 17) because a pixel state after application of the pulse $V_{A1}$ is affected by the crosstalk due to application of subsequent data signals.

Figure 17:
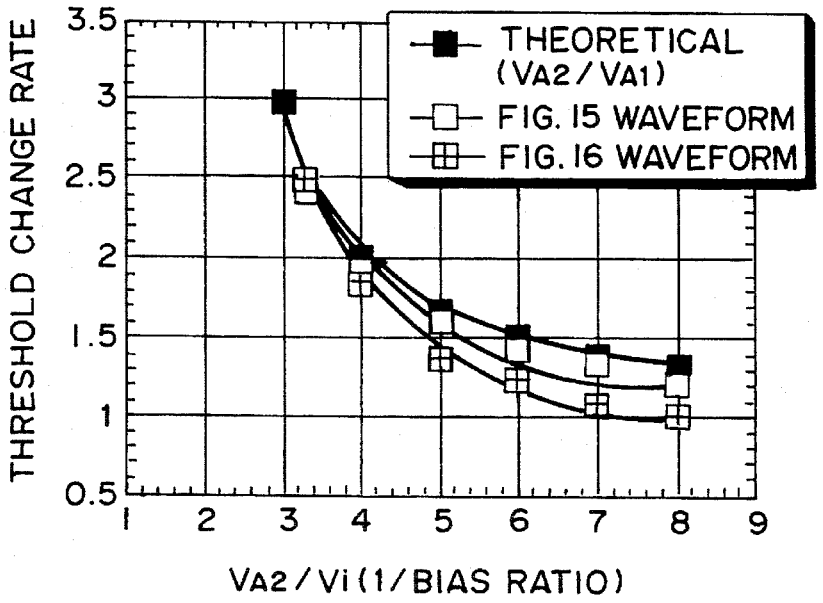
FIG. 17 is a graph showing a relationship between a threshold change rate and a writing voltage.

However, if Data signal 5 (100%) and Data signal 1 (0%) each having a crosstalk-prevention signal, shown in FIG. 15, are used for writing "white" and "black", respectively, it is possible to obtain a threshold change rate γ which is substantially identical to $V_{A1}/V_{A2}$ as shown in FIG. 17, thus being able to realize a binary display in a broader temperature range.

This embodiment is described in further detail.

In a specific example 1, a liquid crystal cell subjected to an identical aligning treatment and using an identical liquid crystal material as used in the first embodiment was used except that the cell spacing between the opposite electrodes was uniformly 1.08 μm. The white-writing voltage in the waveform A was set to 21.6 volts, and the voltages Vi and Vs were set as follows in relation to a bias ratio B:

Vs+Vi=21.6

(Vs+Vi)/Vi=B (definition), ∴Vs=(B−1)Vi,

Vi=21.6/B,

Vs=21.6×(B−1)/B.

In case of using such a drive waveform, the question of what degree of threshold change of a liquid crystal material due to a temperature change can be tolerated for a white-black binary display (question of tolerable threshold change in connection with a drive waveform) can be determined by a ratio of [peak-height of pulse (α)]/[peak-height of pulse (β)]which represents a range of from a minimum at which the switching is caused by application of the pulse (α) in the waveform A2 to an upper limit at which the switching is undesirably caused by application of the pulse (β) in the waveform A1.

Theoretically, the following equation is derived based on a bias ratio B:

$$(Vs+Vi)/(Vs-Vi)=[(B-1)Vi+Vi]/[(B-1)Vi-Vi]=B/(B-1) \quad (1)$$

As a test for examining a tolerable threshold change by using Data signals 1 and 5 for writing 0% and 100% in FIG. 15, the pulse widths could be proportionally enlarged at a constant temperature up to how many times while allowing the switching by Data signal 5 and preventing the switching by Data signal 1.

The above similar enlargement (i.e., enlargement while retaining the ratios among the pulses) of the pulses means that the effect of a drive waveform was enhanced relative to the threshold of a liquid crystal material, so that it is possible to analogize the case of a threshold change under application of a constant drive waveform.

The threshold change ratio obtained in the above described manner are plotted in FIG. 17, from which it is understood that the drive waveform in FIG. 15 including a crosstalk-prevention period provided a tolerable threshold change rate close to the theoretical value $V_{A1}/V_{A2}$ and thus showed an effectiveness of the crosstalk prevention in a binary display drive.

[Fourth Embodiment]

In this embodiment, the drive waveforms used in the first embodiment, i.e., those shown in FIGS. 11 and 12, were modified to remove the period A and a one-line scanning period was enlarged to 500 μsec including a period of 80 μsec for actual one line selection and a remaining period of 420 μsec wherein the liquid crystal layer was free from application of an electric field by retaining the scanning lines and the data lines at the reference potential. As a result, it was possible to realize a good halftone display free from crosstalk.

As described above, according to the present invention, it has become possible to realize a good halftone display free from crosstalk due to non-selection signals by providing a crosstalk-prevention period.

What is claimed is:

1. A driving method for a liquid crystal device of the type comprising a pair of oppositely disposed electrode plates having thereon a group of scanning lines and a group of data lines, respectively, and a liquid crystal disposed between the pair of electrode plates so as to form a pixel at each intersection of the scanning lines and data lines, said driving method comprising:

selecting a scanning line from among the scanning lines and applying a scanning selection signal to the selected scanning line at a scanning selection period (C) in one scanning period; and applying a data signal to a data line for an associated pixel on the selected scanning line, said data signal including a first signal in a data signal period (C) synchronized with the scanning selection period (C), a second signal, for compensating for the first signal, in a period (B), and an AC signal in an AC period (A), so that the first signal and the second signal provide a time-integrated voltage of zero to the associate pixel, and the AC signal also provides a time-integrated voltage of zero applied to the associated pixel; and said first signal having a waveform varying depending on gradation data for the associated pixel, and said AC signal having a waveform varying depending on the first signal applied subsequent to the AC signal.

2. A method according to claim 1, wherein the AC signal period (A) is prior to the data signal period (C) in the one scanning period.

3. A method according to claim 1, wherein a preceding voltage pulse in the AC signal has a polarity which is different from that of an initial pulse in the second signal.

4. A method according to claim 1, wherein each pixel has regions of mutually different thresholds.

5. A method according to claim 1, wherein said liquid crystal is a chiral smectic liquid crystal.

* * * * *

UNITED STATES PATENT AND TRADEMARK OFFICE

CERTIFICATE OF CORRECTION

PATENT NO. : 5,532,713

DATED : July 2, 1996

INVENTOR(S) : SHINJIRO OKADA, ET AL.

It is certified that error appears in the above-identified patent and that said Letters Patent is hereby corrected as shown below:

In the drawings:

SHEET 2

Figure 1A:
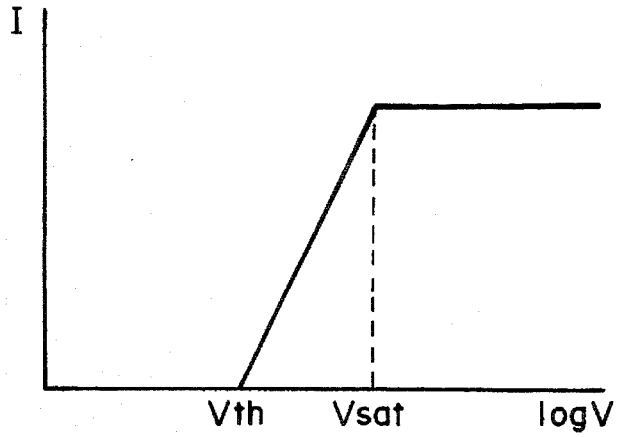
FIGS. 1A and 1B are graphs illustrating a relationship between switching pulse voltage and transmitted light quantity contemplated in a conventional areal modulation method.
Figure 1B:
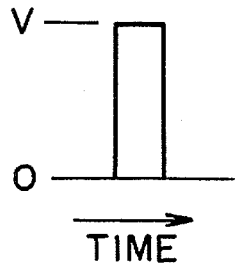
Figure 2A:
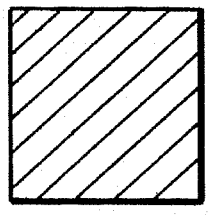
FIGS. 2A–2D illustrate pixels showing various transmittance levels depending on applied pulse voltages.
Figure 2B:
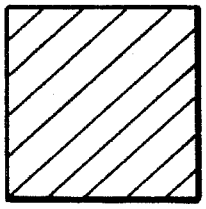
Figure 2C:
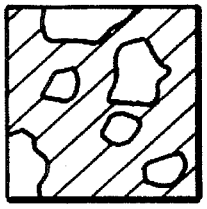
Figure 2D:
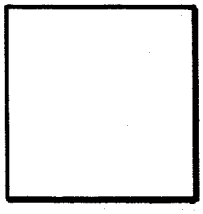
Figure 3:
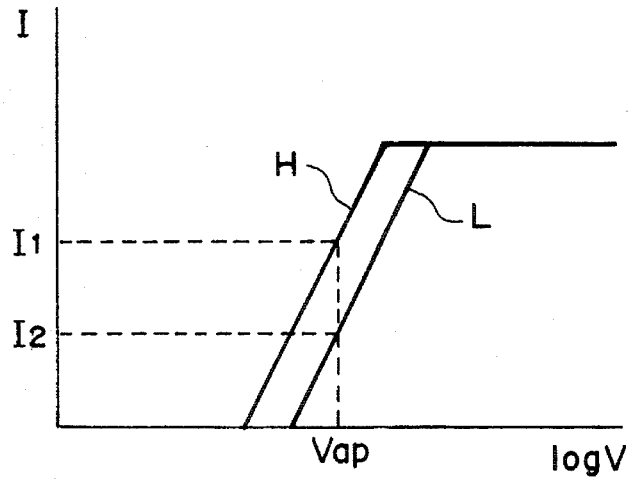
FIG. 3 is a graph for describing a deviation in threshold characteristic due to a temperature distribution.
Figure 4:
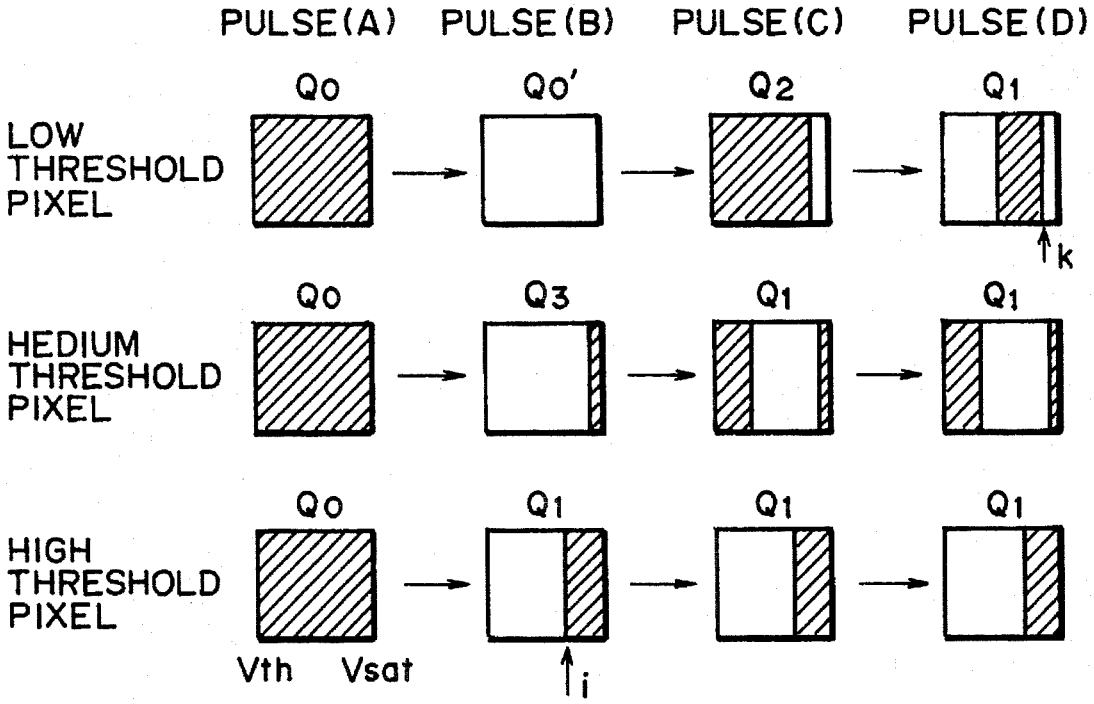
FIG. 4 is an illustration of pixels showing various transmittance levels given in the conventional four-pulse method.
Figure 5:
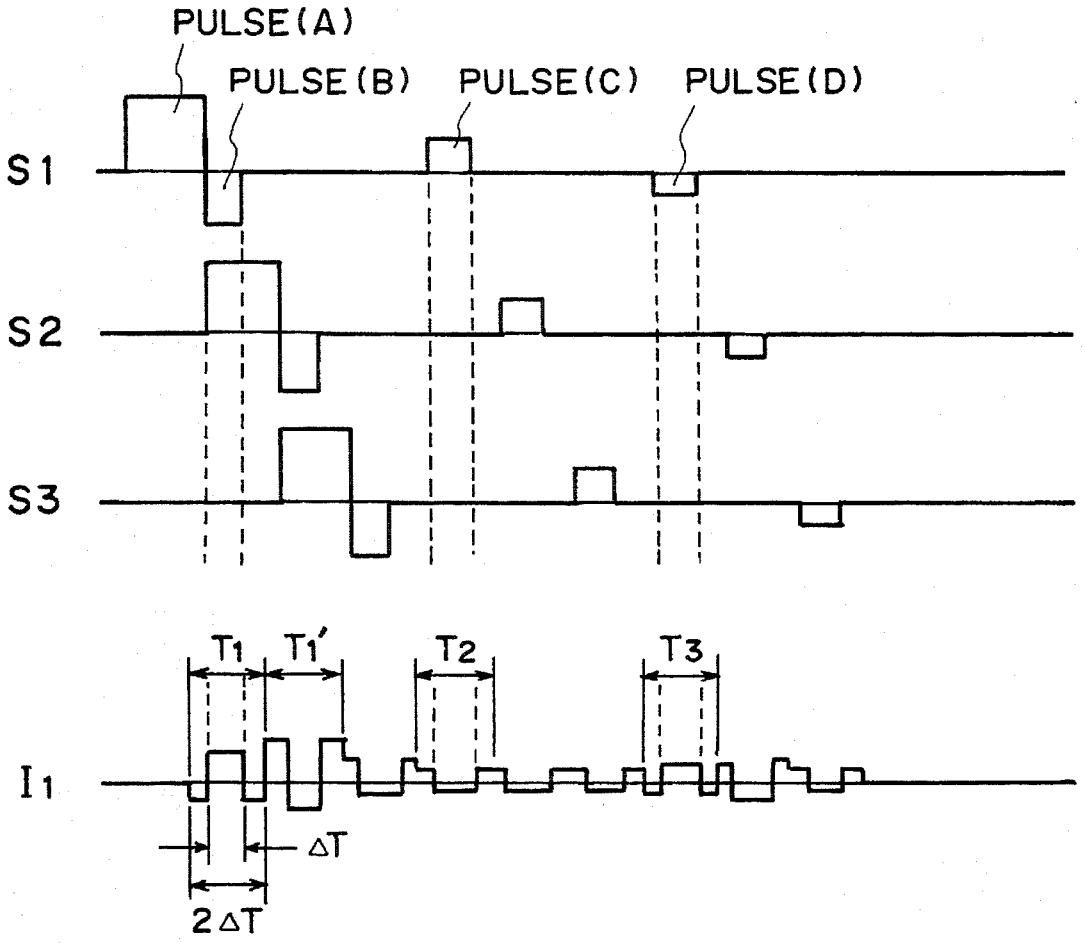
FIG. 5 is a time chart for describing the four-pulse method.

FIG. 4, "HEDIUM" should read --MEDIUM--.

COLUMN 1

Line 12, "bee" should read --been--.

COLUMN 9

Line 67, "embodiment" should read --embodiment of--.

UNITED STATES PATENT AND TRADEMARK OFFICE

CERTIFICATE OF CORRECTION

PATENT NO. : 5,532,713

DATED : July 2, 1996

INVENTOR(S) : SHINJIRO OKADA, ET AL.

It is certified that error appears in the above-identified patent and that said Letters Patent is hereby corrected as shown below:

COLUMN 11

Line 41, "canceling" should read --cancelling--.

Signed and Sealed this

Eleventh Day of February, 1997

Bruce Lehman

*Attest:*

BRUCE LEHMAN

*Attesting Officer*

*Commissioner of Patents and Trademarks*